United States Patent [19]

Vetter

[11] Patent Number: 5,076,535

[45] Date of Patent: Dec. 31, 1991

[54] FOUNDATION FORM BRACE

[76] Inventor: John F. Vetter, P.O. Box 1388, Sequim, Wash. 98382

[21] Appl. No.: 107,933

[22] Filed: Oct. 13, 1987

[51] Int. Cl.[5] ..... E04G 17/06

[52] U.S. Cl. ..... 249/219.1; 249/3; 249/8; 249/34; 249/208

[58] Field of Search ..... 249/2–8, 249/14, 34, 163, 208, 216, 219 R

[56] References Cited

U.S. PATENT DOCUMENTS

| | | | |
|---|---|---|---|
| 920,787 | 5/1909 | Sullivan | 249/219 R |
| 1,082,470 | 12/1913 | Phelan | 249/219 R |
| 1,279,059 | 9/1918 | Whiteway et al. | 249/8 |
| 2,313,880 | 3/1943 | Leggett, Sr. | 249/34 |
| 2,894,307 | 7/1959 | Hogan et al. | 249/208 |
| 4,029,288 | 6/1977 | Murphy et al. | 249/219 R |

*Primary Examiner*—James C. Housel

[57] ABSTRACT

A foundation brace and securing device capable of holding both wall forms and foundation forms in position is disclosed. The brace allows one person to pour one continuous piece of foundational concrete.

1 Claim, 1 Drawing Sheet

FOUNDATION FORM BRACE

BACKGROUND OF THE INVENTION

Presently, contractors go through the following steps: a foundation form is set in place; the foundation wall is poured and cured; a form for the side wall is set in place and the side wall is poured.

In order to use a monolithic pour, contractors presently devise a series of cross bars and other supports that are cumbersome and time consuming to erect.

SUMMARY OF THE INVENTION

The disclosed invention is a foundation brace and securing device to be used in the pouring of concrete footing and walls in a monolithic manner. The spacing of the foundation braces will be determined by the height of the wall forms. The foundation brace is secured and held in place by a stake which passes through two holes contained in extension tabs which are connected to the exterior of the foundation brace.

Since the walls of the foundation and footings are held in position by the braces, the footings and walls can be quickly assembled.

DETAILED DESCRIPTION OF THE DRAWINGS

Figure 1:
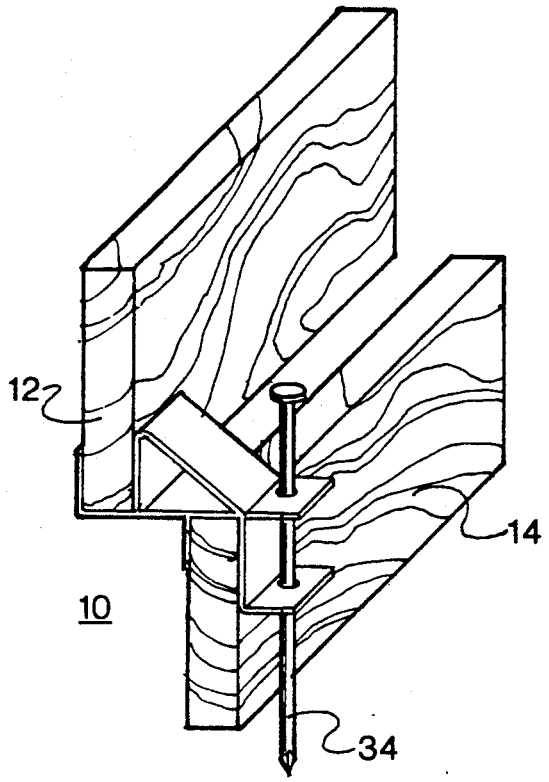
FIG. 1 is a perspective view illustrating the foundation brace holding in place a foundation form and wall form.

The foundation brace 10 is illustrated holding both the wall form 12 and the foundation form 14 in position. By holding both the foundation forms 14 and the wall forms 12 in position simultaneously, the contractor is capable of a monolithic pour of the foundation and walls.

Figure 2:
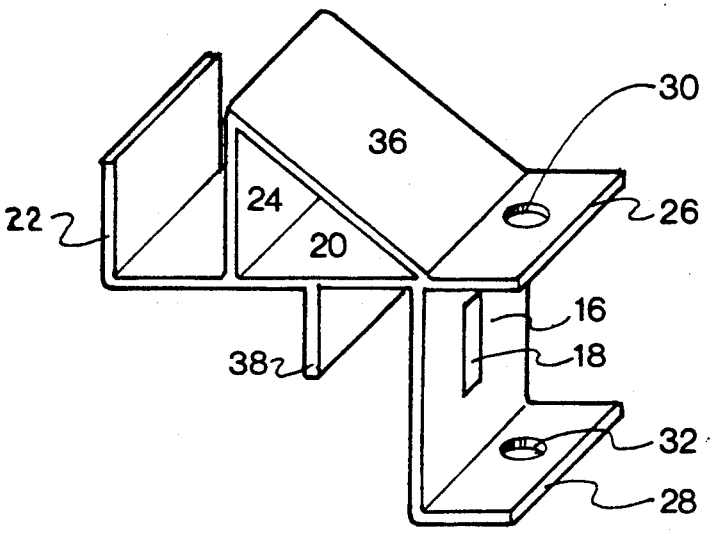
FIG. 2 is a side view of the foundation brace.

The foundation brace, as illustrated in FIG. 2, includes a downwardly extending first channel wall 16, which interfaces against the side wall of the foundation form 14. The foundation brace first channel wall 16 includes slot 18. The slot 18 allows for the contractor to secure the foundation brace first channel wall 16 against the foundation form.

Secured to the foundation brace first channel wall 16 at right angles is floor 20. The floor 20 extends from the top of the foundation brace first channel wall 16 for a distance sufficient to allow the wall forms 12 to rest on the floor 20. Extending upward vertically from the floor 20 is lip 22. The lip 22 extends from the far end of the floor 20 from first channel wall 16 and is of sufficient height to assist in holding wall form 12 in place.

Extending at right angles form the floor 20 is second channel wall 24. Second channel wall 24 is of sufficient length to provide support to wall forms 12. Thus, the length of the second channel wall 24 will vary with the size of the wall forms that need to be secured.

Extending from the first channel wall 16 are extension tabs 26 and 28. Positioned through extension tabs 26 and 28 are holes 30 and 32. The holes 30 and 32 through the extension tabs allow for a stake 34 to be driven through the tabs and thus hold the foundation brace 10 in place.

Extending from the floor 20 is lip 38 which is side by side to first channel wall 16 in a manner similar to the juxtaposition of lip 22 and second channel wall 24. Lip 38 is of sufficient length to assist in holding foundation form 14 in place.

In the preferred embodiment, a support bar 36 extends between the second channel wall 24 and the floor 20. The sole purpose of the support bar 36 is for added strength.

To better understand the foundation brace, the steps in setting the foundation brace in place will be set forth.

First, the foundation brace is attached to the foundation forms 14. After this is accomplished, a stake 34 is driven through the holes 30 and 32 of the extension tabs 26 and 28. This gives the foundation brace a firm position. After one foundation brace is positioned, other foundation braces are also positioned along the length of the foundation forms.

After securing the foundation braces to the foundation forms, the wall forms 12 are set in place resting on the floor 20 between the lip 22 and the second channel wall 24. The weight of the wall tends to attempt to pull the first channel wall 16 from the foundation forms 14. However, based on the strength of the stake 34, which has been pounded into the ground, this movement is prevented. This gives added strength to the securing of the wall form 12.

When opposing foundation forms and wall forms are set in place, a tie can be placed at the top side of the wall forms thus holding them in position. Once the monolithic pour begins, the wall forms will attempt to move away from each other. This movement, however, is prevented by the stakes 34 and the second channel wall 24.

I claim:

1. A device for securing foundation forms and wall forms in position in relation to each other comprising:

a floor;

a pair of spaced upwardly extending walls at one end of the floor for receiving a wall form therebetween;

a downwardly extending wall having a pair of apertured extension tabs for receipt of a stake therethrough, said wall positioned at a distance at the opposite end of the floor from the pair of spaced upwardly extending walls to allow the downwardly extending wall to be secured to a foundation form.

* * * * *